US007828355B2

(12) United States Patent
Kohn et al.

(10) Patent No.: US 7,828,355 B2
(45) **Date of Patent: *Nov. 9, 2010**

(54) CARRYABLE BAG FOR LARGE OBJECTS

(75) Inventors: Albert Kohn, Woodsburgh, NY (US); Johan Blok, Astoria, NY (US)

(73) Assignee: U-Haul International, Inc., Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/401,516

(22) Filed: Mar. 10, 2009

(65) Prior Publication Data

US 2009/0170681 A1 Jul. 2, 2009

Related U.S. Application Data

(62) Division of application No. 11/176,888, filed on Jul. 7, 2005, now Pat. No. 7,585,007.

(60) Provisional application No. 60/585,992, filed on Jul. 7, 2004.

(51) Int. Cl.
*B65G 7/12* (2006.01)
*B65D 33/08* (2006.01)
*B65B 25/00* (2006.01)

(52) U.S. Cl. ..... 294/152; 294/149; 383/10; 383/16; 383/21

(58) Field of Classification Search ..... 294/15, 294/137, 149, 152; 383/7, 10, 16, 20, 21; 5/510, 703
See application file for complete search history.

(56) References Cited

U.S. PATENT DOCUMENTS 2,789,571 A * 4/1957 Kurman ..... 135/34.2
3,206,104 A * 9/1965 Cohen ..... 16/407
3,282,621 A * 11/1966 Peterson ..... 294/68.3
3,462,069 A * 8/1969 Suominen ..... 383/10
3,884,411 A * 5/1975 Carlson et al. ..... 229/117.23
3,955,826 A * 5/1976 Riedesel ..... 280/35
4,119,250 A * 10/1978 Brutlag ..... 294/149
4,431,226 A * 2/1984 Weilert ..... 294/150
4,434,829 A * 3/1984 Barnard ..... 383/34
4,521,045 A * 6/1985 Hart ..... 294/149
4,524,457 A * 6/1985 Marino ..... 383/17
4,790,670 A * 12/1988 Barbaro ..... 383/62
4,797,010 A * 1/1989 Coelho ..... 383/109
4,872,766 A * 10/1989 Dancy ..... 383/10
4,953,904 A * 9/1990 Danboise ..... 294/15
4,968,049 A * 11/1990 Johnson ..... 280/47.24
5,015,103 A * 5/1991 Mercer ..... 383/10
5,033,868 A * 7/1991 Peppiatt ..... 383/29
5,076,710 A * 12/1991 Derby ..... 383/22
D377,433 S * 1/1997 Funk et al. ..... D6/596
5,722,773 A * 3/1998 Conrad ..... 383/10
5,758,971 A * 6/1998 Goglio et al. ..... 383/10

(Continued)

*Primary Examiner*—Dean J Kramer
(74) *Attorney, Agent, or Firm*—Richard E. Oney; Tiffany & Bosco, P.A.

(57) ABSTRACT

A method for manufacturing a carrier for large objects includes forming a bag from a sheet of plastic film material. The bag is sized to receive a large object and has an opening for placing the object into the bag. An extension is formed on at least one side or end of the bag. The extension comprises a plurality of layers of the plastic film material. Handles are formed as openings in the extension.

20 Claims, 8 Drawing Sheets

U.S. PATENT DOCUMENTS 5,863,056 A * 1/1999 Hostetter ..... 280/47.371
6,309,000 B1 * 10/2001 Pittman ..... 294/15
6,361,209 B1 * 3/2002 LaRue et al. ..... 383/10
6,431,752 B1 * 8/2002 Diplock ..... 383/5
2007/0071370 A1 * 3/2007 Schneider ..... 383/119

* cited by examiner

CARRYABLE BAG FOR LARGE OBJECTS

RELATED APPLICATION

This application is a divisional of and claims the priority of U.S. non-provisional patent application Ser. No. 11/176,888, filed Jul. 7, 2005, now U.S. Pat. No. 7,585,007 entitled "Carryable Bag for Large Objects," which is incorporated herein by reference. This application claims priority of, and incorporates by reference, U.S. provisional patent application Ser. No. 60/585,992 filed on Jul. 7, 2004.

FIELD OF THE INVENTION

The present invention relates to a bag for moving, carrying and storing large objects.

BACKGROUND

A problem in moving furniture is moving large objects without damaging the object or it being too cumbersome. Objects such as rugs, large painting, couches, table, floor lamps, etc. are very cumbersome to be moved without being damaged. Dragging an object such as this causes damage and soilage to the object. These types of objects are heavy, hard to get a good grip on, and cumbersome to handle.

U.S. Pat. No. 4,953,904 relates to a mattress carrier, of molded, integrated, high impact plastic construction, having a pair of opposed sides and a bottom that form an open ended cradle.

U.S. Pat. No. 6,309,000 relates to an article carrier with an adjustable cradle portion for receiving and supporting articles having various thicknesses, and a handle portion for accommodating users of various heights.

U.S. Pat. No. 5,863,056 relates to a mattress moving system which includes a horizontal strap with two detachable, rotating and adjustable handles, a pair of vertical straps, each with an expandable detachable and position adjustable castered platform. The horizontal strap wraps around and is secured to the mattress lengthwise while the handles are positioned on opposite mattress end edges, the vertical straps extend from the horizontal strap on opposite sides of the mattress and wrap halfway around the mattress widthwise, while the castered platforms are positioned on the mattress side edges and slidably attached to each vertical strap.

U.S. Pat. No. 4,968,049 relates to a mattress moving arrangement which includes a plurality of legs configured in "A" shaped orientation formed with an orthogonal extending handle relative to the intersection defined by the aforenoted legs. The lowermost portion of the legs include "L" shaped members for receiving a mattress.

U.S. Pat. No. 4,431,226 relates to a large mattress carrying device having a wraparound band or strap mattress carriers to enable two people to carry a large mattress. The device is adjustable to carry more than one size of mattress.

U.S. Pat. No. 3,955,826 relates to a mattress carrier using a horizontal rectangular open frame adjustable in width and length. A plurality of parallel U shaped members is used. Each member is secured at each end to a corresponding side of the frame, extends downward therefrom and then extends transversely between the sides of the frame. The top of the platform carries manually operable clips detachably securable to the transversely extending sections of the members.

U.S. Pat. No. 4,119,250 relates to a mattress carrying device comprised of a heavy cloth-like material and shaped as a rectangular parallelepiped and has sides or ends having a length corresponding to the length of a king-sized mattress and a bottom having a width corresponding to the thickness of a king-sized mattress. A pair of carrying straps of endless square configuration are affixed to the bottom of the material and to the sides at corresponding opposite ends of the parallelepiped. The straps extend in loops from the opposite ends of the parallelepiped at angles with the bottom, whereby two people, each holding the extending part of a corresponding one of the straps, support and carry a mattress placed in the material and resting on the bottom thereof.

U.S. Pat. No. 4,521,045 relates to a mattress carrier for containing and protectably enclosing a mattress and for facilitating handling of the mattress during transportation to a location of use. The carrier comprises a flexible, rectangular cover designed to receive and contain a mattress therein. The cover has an upper zippered opening, sets of reinforcing strap bands and spaced pairs of handles on opposite ends of the cover to be gripped by respective deliverymen to support the mattress in a generally vertical plane. The handles which may be formed of flexible looped ends of the reinforcing bands are spaced along the ends of the cover on opposite ends of a midline of the mattress carrier, such that the mattress and carrier may be easily manipulated and reoriented about the midline in confined spaces to facilitate handling of the same.

SUMMARY OF THE INVENTION

The present invention relates to a bag with built in handles. It is an object of the present invention for the bag to be easy to grip and handle. It is an object of the present invention for the bag to be used to transport large objects.

The present invention relates to a polyethylene bag with built in handles to carry and transport a large object. It is an object of the present invention for the device to protect against water, dirt and stains. It is an object of the present invention to provide a means for easily lifting, carrying and transporting the object from one place to another.

It is an object of the present invention for the device to be made of a flexible material, such as, canvas, vinyl, non-woven fabric, polyethylene, or polypropylene.

The handles are built into the extensions of the bag and are easy to grab while the mattress is standing vertically on its end, horizontally on its edge, or while laying flat.

It is an object of the present invention to eliminate the strain of having one or more persons try to grip the object through the plastic in an effort to lift and move it with nothing to grab onto. The easy to grip, built-in handles, provide a convenient means of carrying any large object for an extended period of time.

It is an object of the present invention for the built-in handles to be placed in the extensions on each side of the bag. It is the object of the present invention for the built-in handles to be placed in the extensions on each end of the bag. It is an object of the present invention for the built-in handles to be placed in the extension of the closed end, with additional handles in both the front and back of the bag at the open end.

It is an object of the present invention to provide a large object carrier which protects the object and facilitates handling, storing, moving and delivery of the same to a location of use.

It is an object of the present invention to provide a large object carrier which serves as a protective cover to avoid soiling and damage of the object during delivery, and which has carrying handles located at spaced locations. It is an object of the present invention to enable the object carriers to be folded and stored in a compact condition when not in use.

The present invention relates to a large plastic bag with sturdy handles built into an extension of multiple layers of film on one or both sides (or ends) that enables one or more persons, without strain, to easily carry an object in the bag.

It is an object of the present invention for the device to protect, store or transport a large cumbersome object. An object is inserted into the bag through the open end (or side). After inserting the object, additional film is provided at the open end to be folded over and taped (sewn or sealed) closed. The object is then transported to a new location, where it can be stored within the carrier or where the bag is opened to remove the object from the bag.

It is an object of the present invention to place built-in die cut handles in the film extended beyond the sealed area.

It is an object of the present invention for handles to be positioned at one or both sides (or ends) of the bag. If is an object of the present invention for multiple handles to be placed in specific positions or at random though the film extended beyond the sealed area.

It is an object of the present invention for the built-in handles to have multiple layers of film, (four or more, instead of just two) in the area extended beyond the seals. It is a further object of the invention to seal vertically along the entire inside edge of each bag to bond two or more layers of film together which allows a thinner, more cost effective film to be used, while still providing adequate strength to carry heavy objects in the bag.

It is an object of the present invention to transport a variety of large, difficult to handle products such as a roll of carpet, floor lamp, pieces of sheet rock wall panels, office partitions, etc.

It is an object of the present invention for the bag to be economically produced in-line so that the extrusion and bag making process can be done without interruption until the bag is completed, including the die cut handles, sealed extensions and sealed bottom.

It is an object of the present invention for the bag to be produced not in-line in a conversion process with the same die cut handles, sealed extensions and sealed bottom after the extrusion is completed.

It is an object of the present invention to be able to use a wide variety of flexible film which can be produced in bag form (closed at one end) or sleeve form (open at both ends), with built-in handles die cut into the film extended beyond the enclosed interior area, at one or both sides (or ends) of the bag or sleeve.

It is an object of the present invention for vertically sealed extensions to be provided on one or both sides as a means of providing multiple layers of film bonded together to produce greater strength for the handles in the area of film extended beyond the inner seals.

It is an object of the present invention to provide film extensions (with or without handles) on one or both sides (or ends) to provide a means of easily gripping the bag.

It is an object of the present invention to provide a heavier gauge film rather than multiple layers to support the handle grips placed in the extended area beyond the inner seals.

It is an object of the present invention for the handles to be placed in the extended area by means of a die cut through a heat sealed "patch reinforcement", burned through, applied as a rigid or flexible handle and riveted through the plastic with a cardboard reinforcement, or die cut through an applied pressure sensitive patch reinforcement.

BRIEF DESCRIPTION OF THE DRAWINGS

Throughout the following views, reference numerals will be used in the drawings, and the same reference numerals will be used throughout the several views and in the description to indicate same or like parts of the invention.

DESCRIPTION

The present invention relates to a bag having built-in handles for carrying large objects. In an embodiment, the bag is made of polyethylene. The bag is designed to protect against water, dirt and stains and provides a means of easily lifting, carrying and transporting a large object from one place to another.

Figure 1:
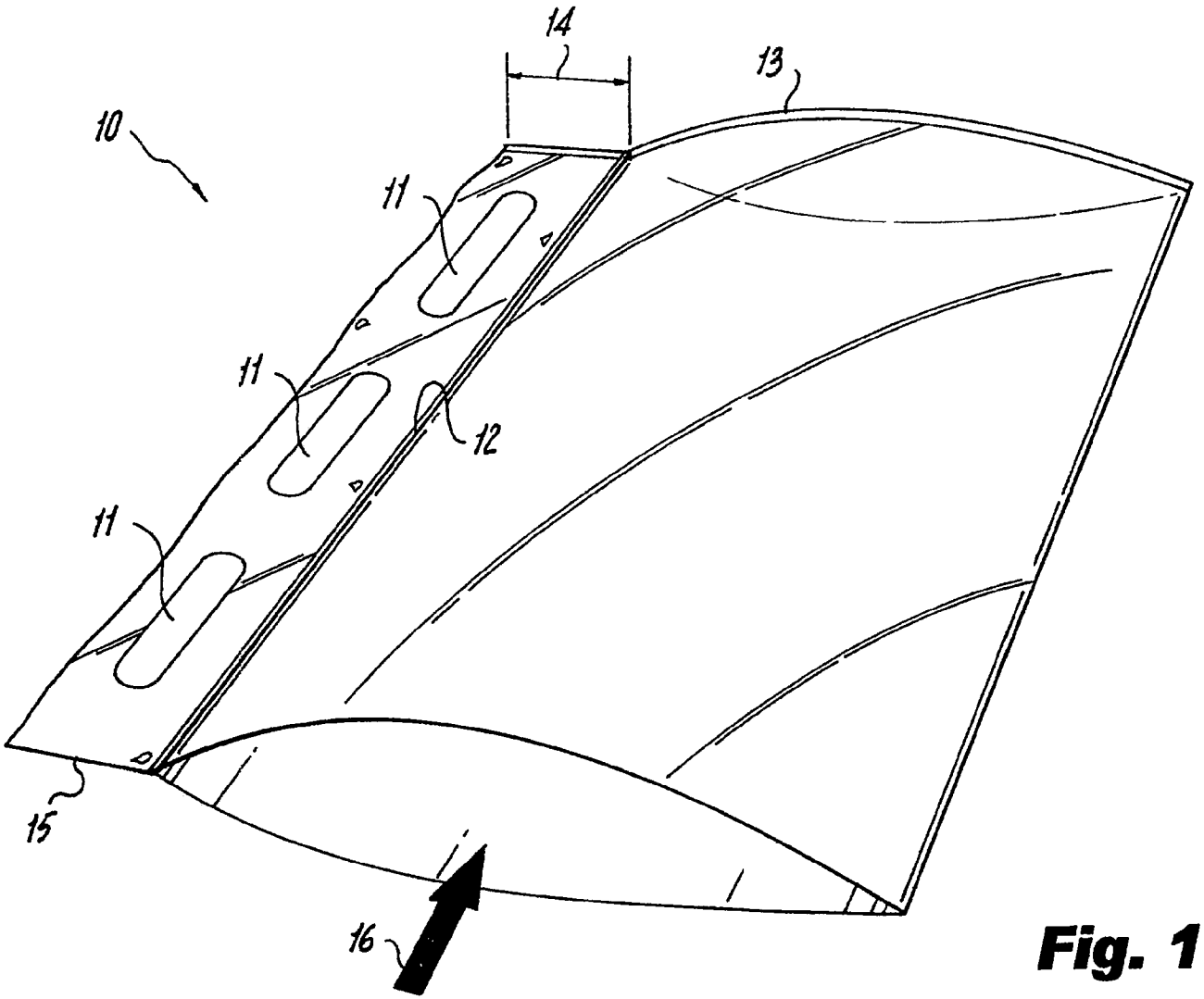
FIG. 1 shows an end open bag construction with handles on one side through one layer of film according to the present invention.
Figure 2:
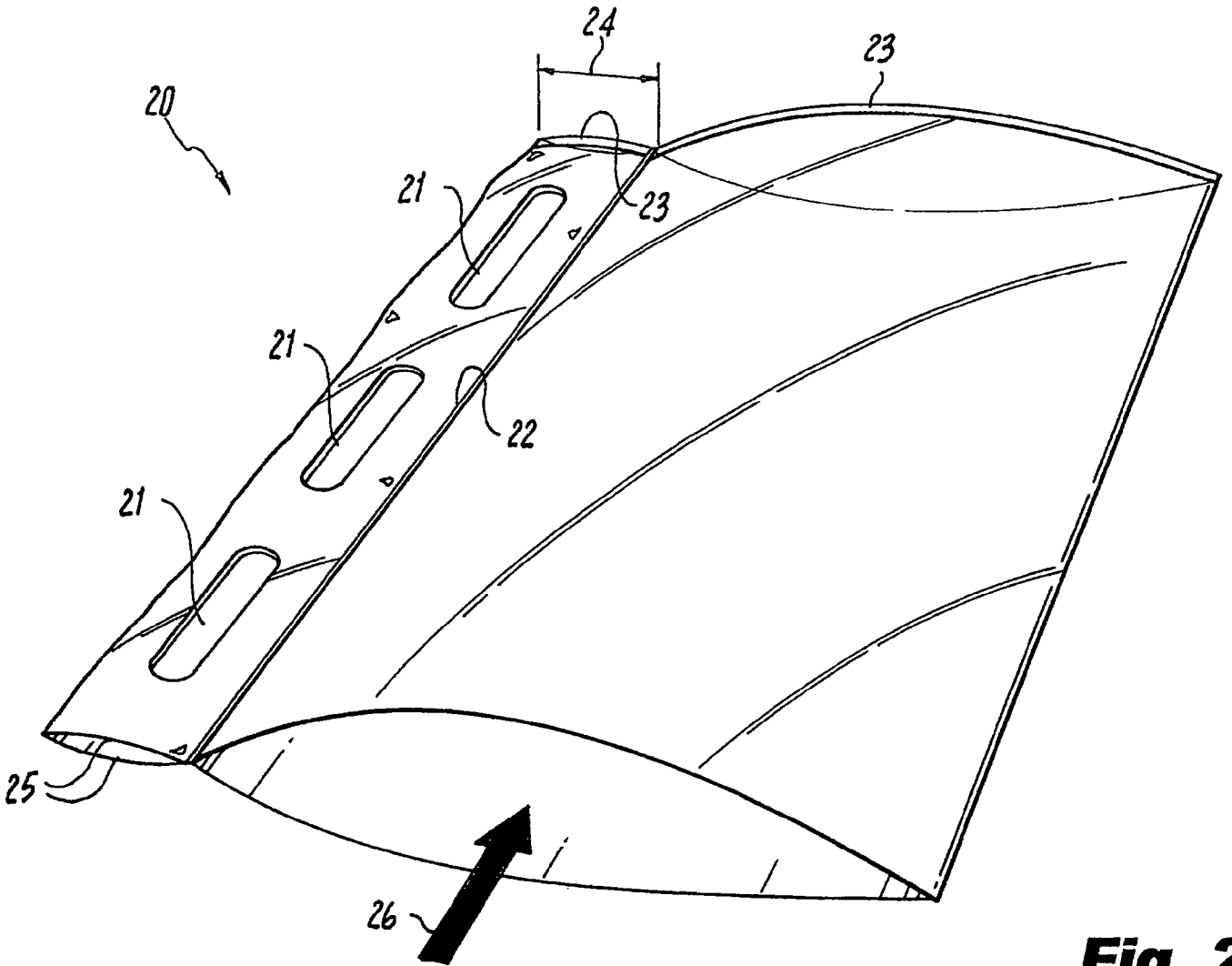
FIG. 2 shows an end open bag construction with handles on one side through two layers of film according to the present invention.
Figure 3:
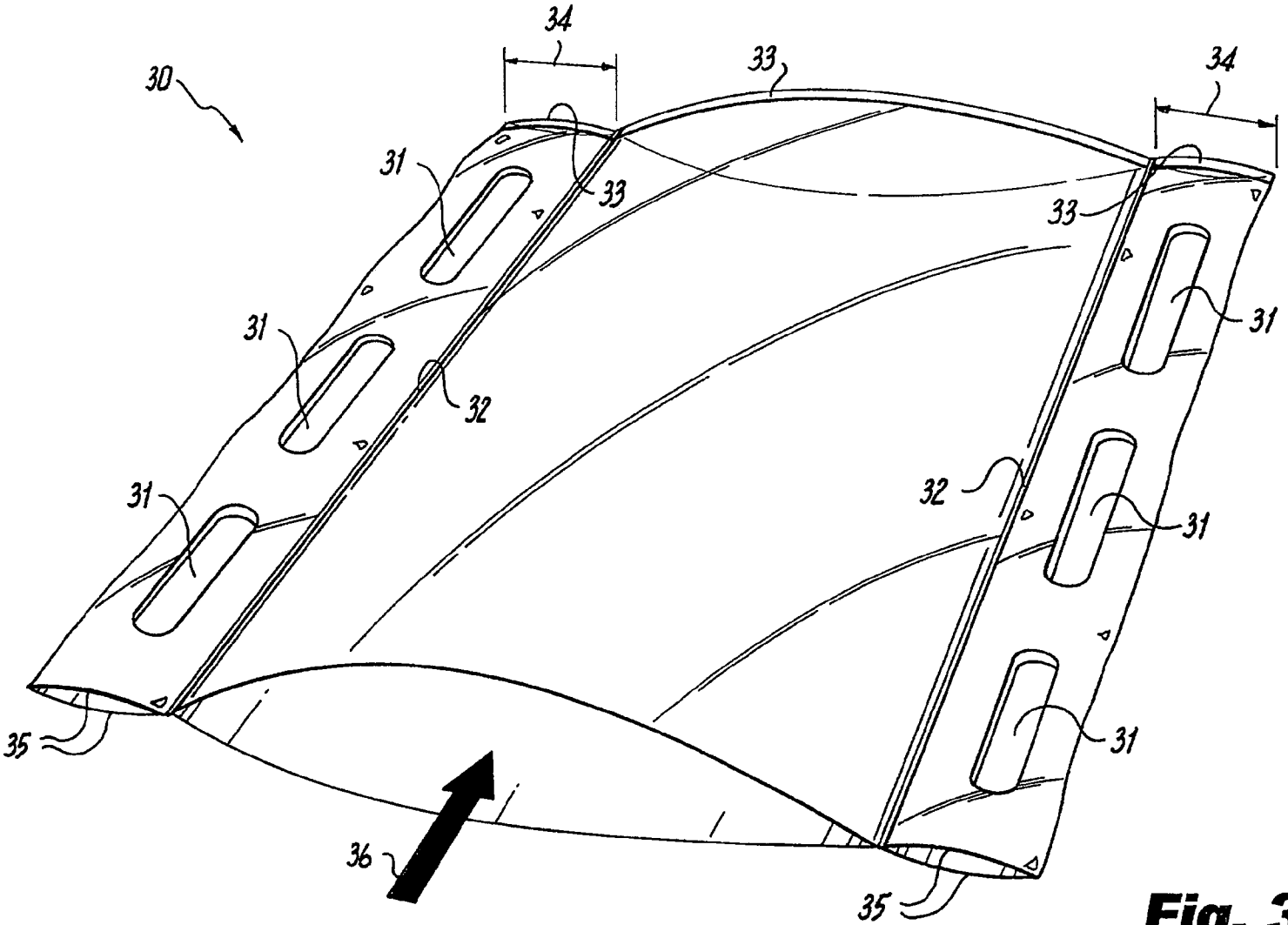
FIG. 3 shows an end open bag construction with handles on two sides through two layers of film according to the present invention.
Figure 4:
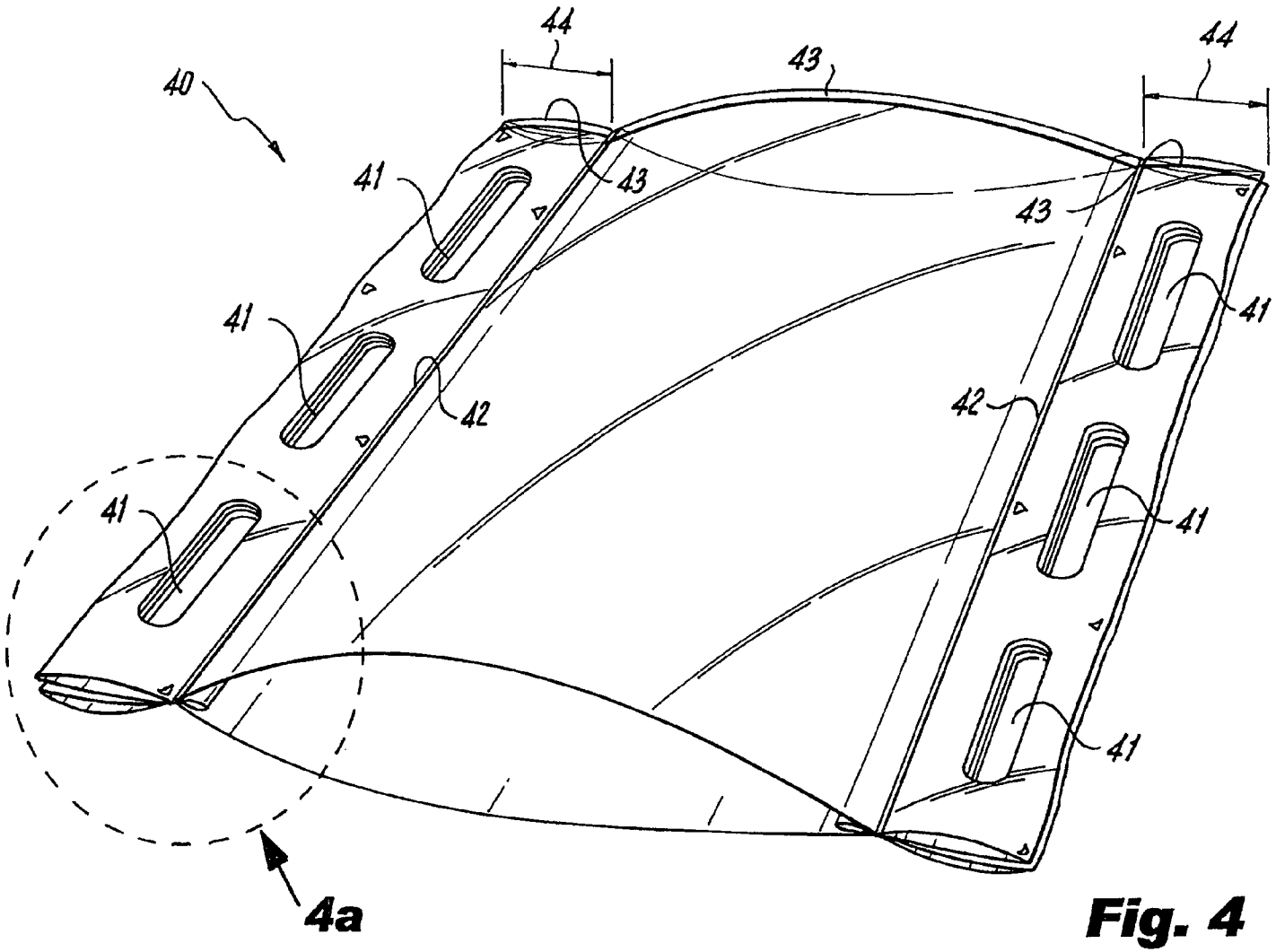
FIG. 4 shows an open end bag construction with handles on two sides through four layers of film according to the present invention.
Figure 5:
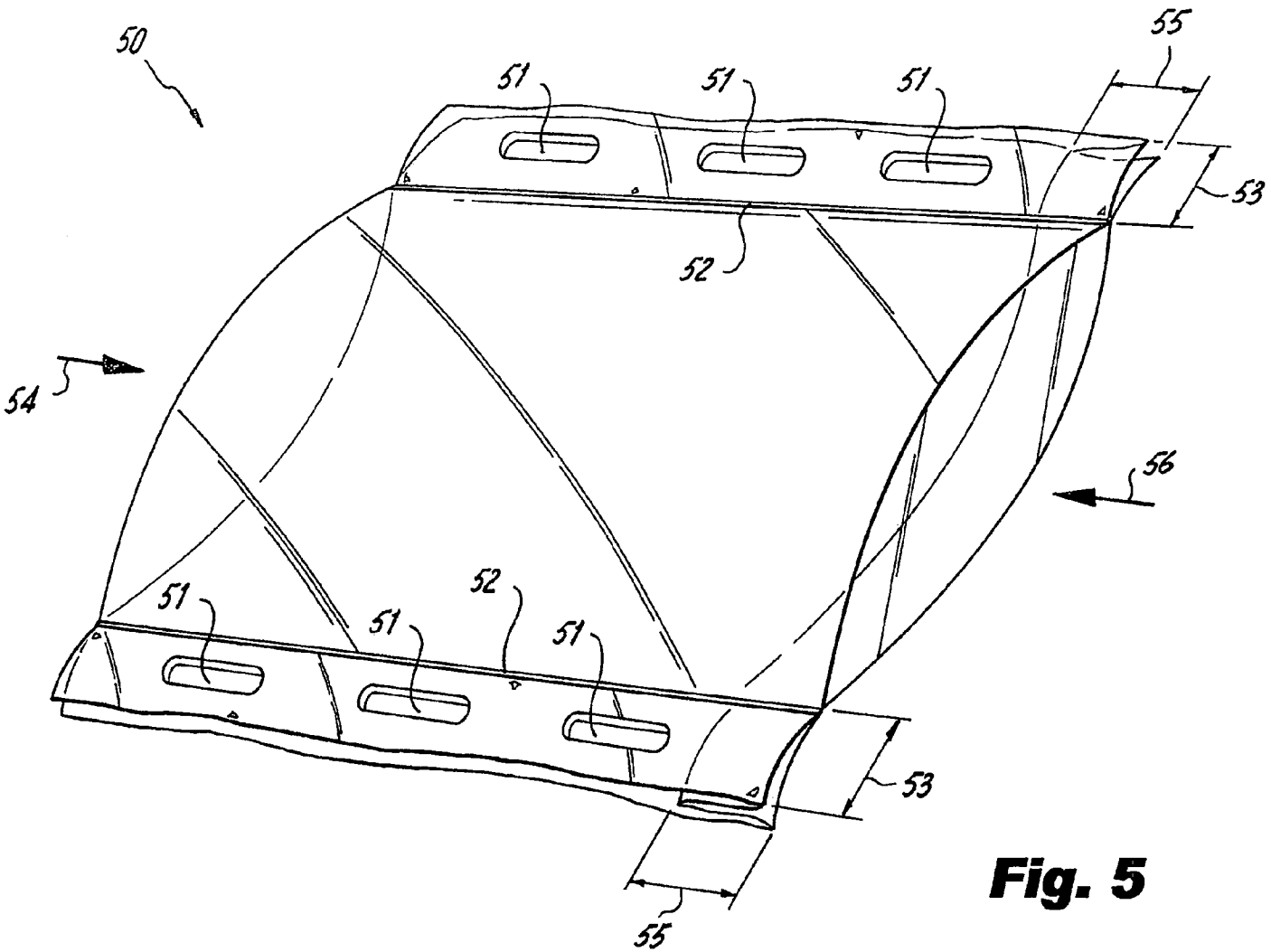
FIG. 5 shows a side open bag construction with handles on both ends through two layers of film according to the present invention.
Figure 6:
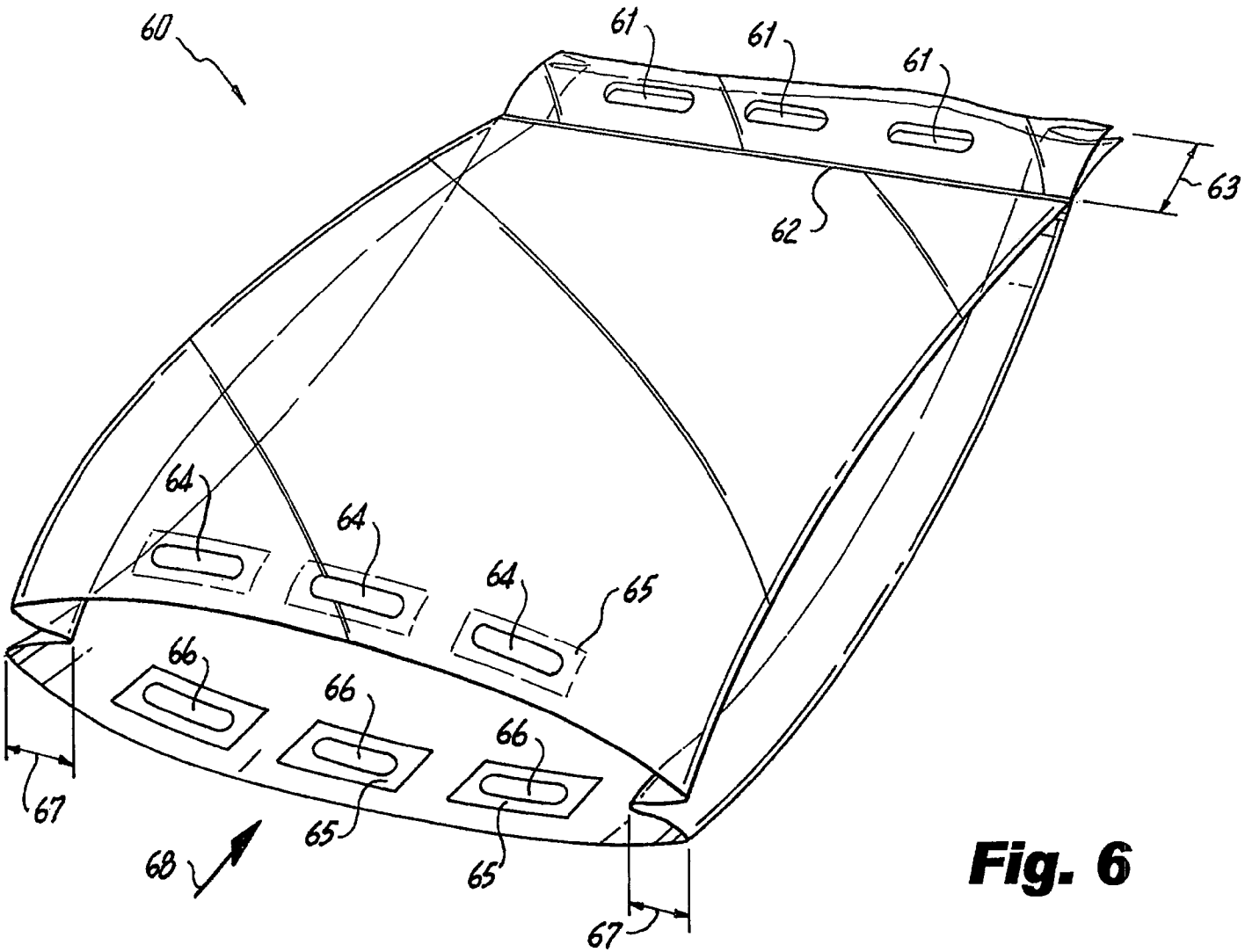
FIG. 6 shows an open end bag construction with handles on both ends according to the present invention.

The handles are built into the extensions of the bag and are easy to grab while the object is standing vertically on its end, horizontally on its edge, or while laying flat. This eliminates the strain of having one or more persons trying to grip the object through the plastic in an effort to lift and move it with nothing to grab onto. The handles provide a convenient means of carrying an object for an extended period of time. The built in handles are placed in the extensions on one side of the bag as shown in FIGS. 1 and 2 (with the opening on one end), the extensions on each side of the bag as shown in FIGS. 3 and 4 (with the opening on one end), built in handles are placed in extensions on both ends of the bag as shown in FIG. 5 (with the opening on one side) or handles on both ends and an opening at one of the ends as shown in FIG. 6.

Any type of flexible material like canvas, vinyl, non-woven fabric, polyethylene, polypropylene, etc. may be used to produce this same type of bag with extensions to provide easy to grip, built-in handles.

In an embodiment, the bag is made with sturdy cut-out handles built into an extension of multiple layers of film on one or both sides (or ends) that enables one or more persons, without strain, to carry the object placed in the bag. The object is inserted into the bag through the open end or side. After inserting the object, additional film is provided at the open end which is folded over and taped (sewn or sealed) closed. The object is then transported to its new location. The object can then be stored in the same bag to provide protection against soilage and water damage. After removing the object from the bag, the bag itself can then be folded and stored in a compacted form.

By placing built-in, die cut handles in the film extended beyond the sealed area, the bag serves its primary function of protecting its contents, while providing the additional feature of allowing one or more persons to carry the bag by means of gripping the readily accessible built-in handles.

The handles can be positioned at one or both sides (or ends) of the bag. Multiple handles can be placed in specific positions or at random through the film extended beyond the sealed area.

In its most simple form, the bag is made with a lip on one side, where the die cut handles are built in, consisting of a single layer of film extended beyond the pocket of an open end bag. If needed, reinforcements can be applied to the handle area to provide additional strength.

Sealing vertically along the entire inside edge of each bag bonds two or more layers of film together which allows the handles to be built into multiple layers of thinner, more cost effective film in the extended area beyond the vertical seals, while still providing adequate strength to carry heavy objects in the bag.

Greater strength is achieved for the built-in handles by using multiple layers of film (four or more, instead of just two) in the area extended beyond the seals as shown in FIG. 4.

In a preferred embodiment, the bag is produced in-line, so that the extrusion and bag making process is done without interruption until the bag is completed, including the die cut handles, sealed extensions and the sealed bottom. In a further embodiment, the bag is produced not in-line in a conversion process with the same die cut handles, sealed extensions and sealed bottom after the extrusion is completed.

A wide variety of flexible film can be used to produce this type of carrier in bag form (closed at one end) or sleeve form (open at both ends), with built-in handles cut into the film extended beyond the enclosed interior area, at one or both sides (or ends) of the bag or sleeve.

In an embodiment, vertically sealed extensions are provided on one or both sides as a means of providing multiple layers of film bonded together to produce greater strength for the handles in the area of film extended beyond the inner seals.

In an embodiment, film extensions (with or without handles) are provided on one or both sides (or ends) to provide a means of easily gripping the bag.

In an embodiment, heavier gauge film is used rather than multiple layers of film to support the handle grips placed in the extended area beyond the inner seals.

Handles may be die cut only, die cut through a heat sealed patch reinforcement, burned through, applied as a rigid or flexible handle and riveted through the plastic with a cardboard reinforcement, or die cut through an applied pressure sensitive patch reinforcement.

FIG. 1 shows an end open bag 10 having handles 11 through a single layer of film 15. The seal 12 is on one side along the entire length of bag 10. The bottom of bag 10 has a seal 13. There is an area 14 which extends beyond the area of the seal 12, where the handles 11 are located. The open end 16 of the bag 10 is where the object is placed.

FIG. 2 shows an end open bag construction 20 with handles 21 on one side through two layers of film 25. There is a seal 22 on one side along the entire length of bag 20. Bag 20 has a bottom seal 23. Area 24 extends beyond the side seal 22 where the handles 21 are located. The bag 20 has an open end 26.

FIG. 3 shows an end open bag construction 30 with handles 31 on two sides through two layers of film 35. There are seals 32 along the entire length on both sides of bag 30. Bag 30 has a bottom seal 33. Area 34 extends beyond the side seals 32 and has handles 31. The bag 30 has an open end 36.

Figure 4A:
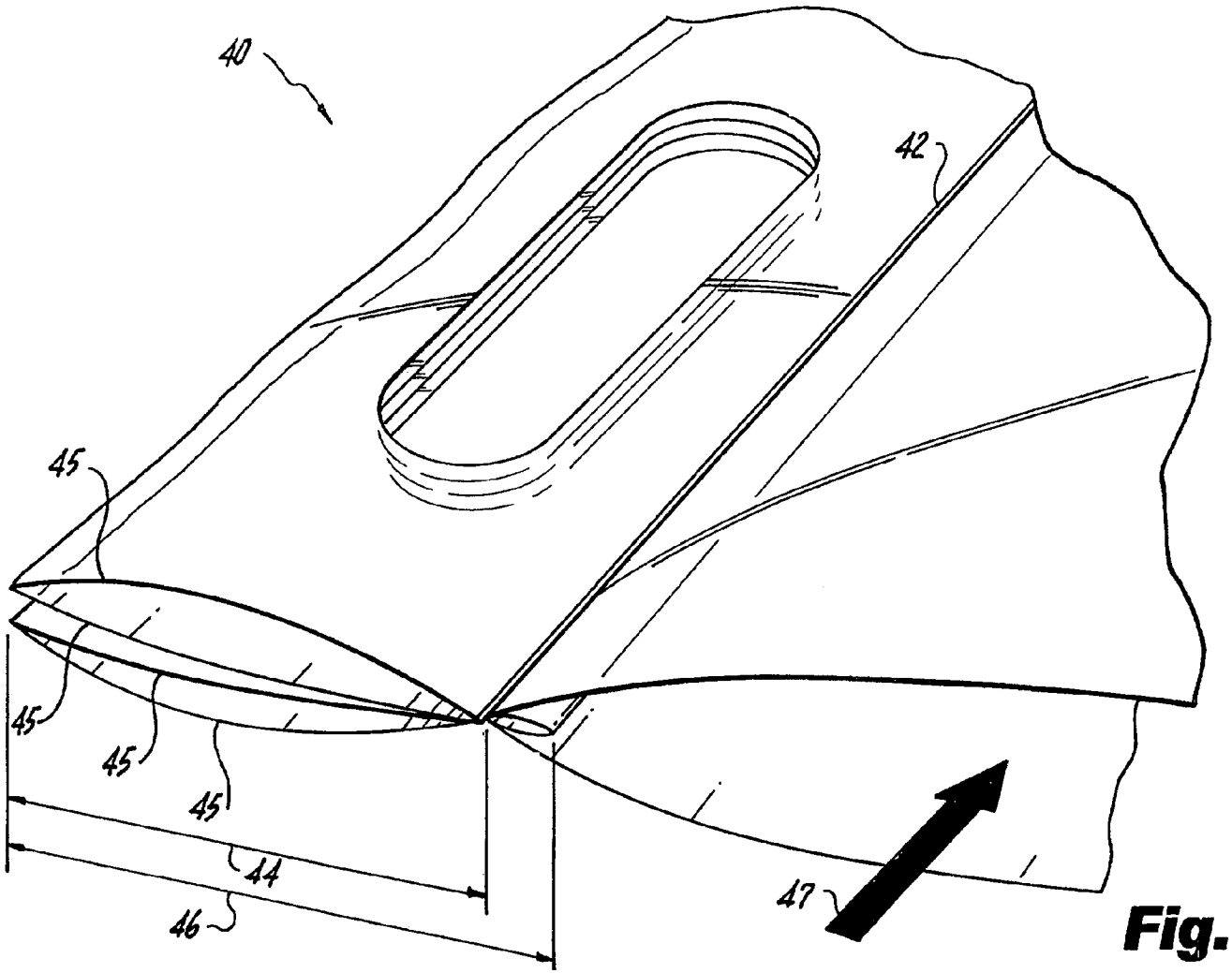
FIG. 4*a* shows a cross section of FIG. 4.

FIGS. 4 and 4*a* shows an end open bag construction 40 with handles 41 on two sides through four layers of gusseted film 45. Seals 42 extend along the entire length on both sides of bag 40. Bag 40 has a bottom seal 43. Area 44 extends beyond side seals 42 and has handles 41. Arrow 46 shows the width of the entire gusset which extends beyond the seal 42. The bag has an opening 47 at one end.

FIG. 5 shows a side open bag construction 50 with handles 51 on both ends through two layers of film. Seals 52 extend along the top and bottom of bag 50. Area 53 extends beyond the top and bottom seals 52 and contain handles 51. Bag 50 has a side opening 54. Side gusset 55 is on the closed side 56 of the bag 50.

FIG. 6 shows an end open bag construction 60 with handles on both ends. Handles 61 are on the bottom of bag 60 through two layers of film. Seal 62 is located along the bottom of bag 60. Area 63 extends beyond the bottom seal 62 and has handles 61. Handles 64 are located on the top side of bag 60. Handles 64 have reinforcement 65. Handles 66 are located on the bottom side of the bag 60 with reinforcement 65. Bag 60 has side gussets 67. Bag 60 has an opening 68 at one end.

Figure 7:
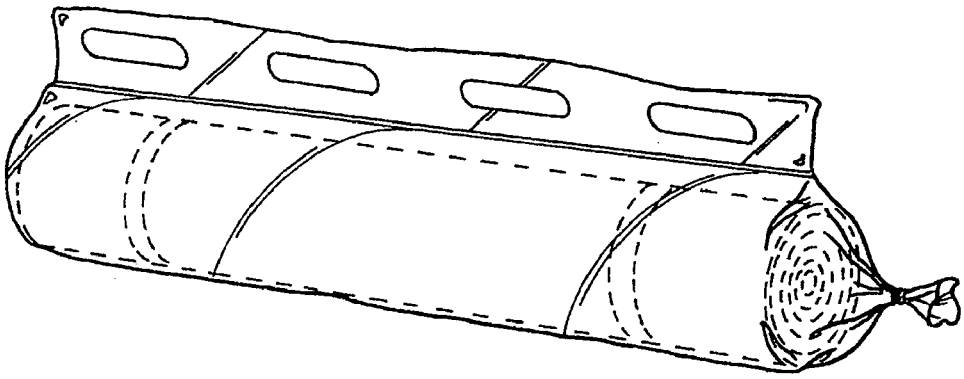
FIG. 7 illustrates the device of the present invention having a rug rolled up inside the bag.

FIG. 7 shows an open end bag construction with handles on one side. The open end is on the side of the bag where the rug is placed inside and then the open end is closed.

Figure 8:
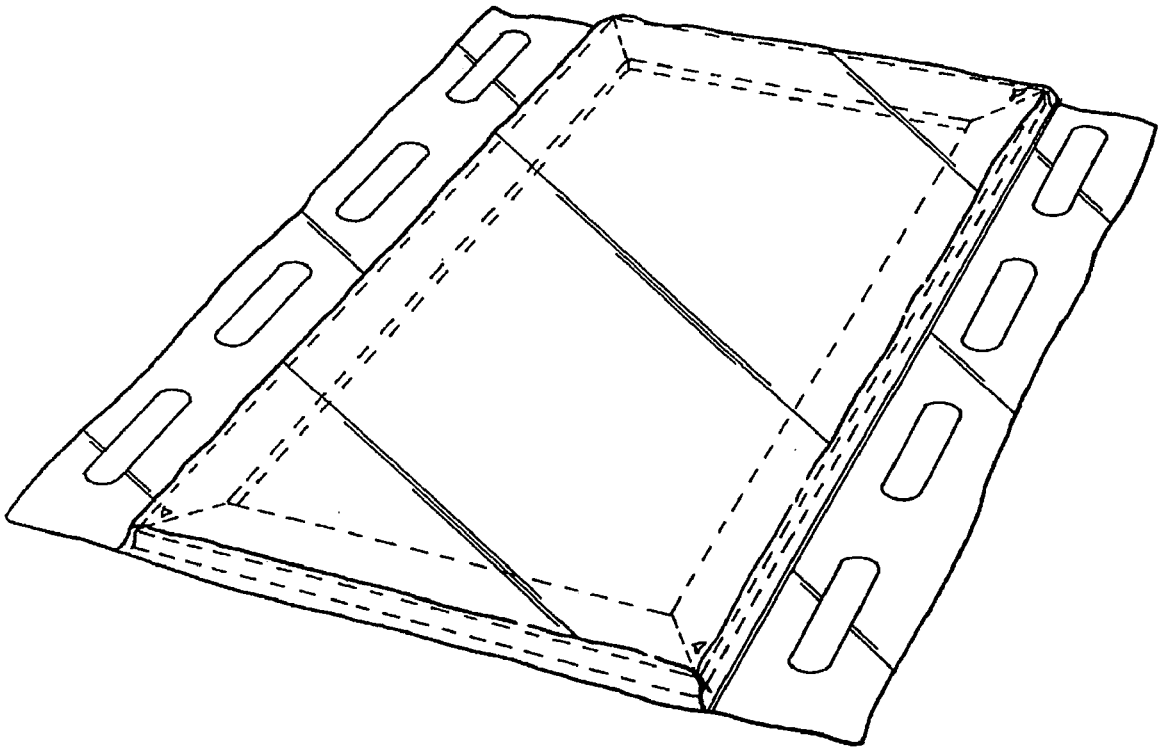
FIG. 8 illustrates the device of the present invention having a picture frame inside the bag.

FIG. 8 show an open end bag construction with handles on both sides. A framed painting is placed in an open end between the handles and then the bag is closed.

The invention has been described by reference to detailed examples and methodologies. These examples are not meant to limit the scope of the invention. Variations within the concepts of the invention are apparent to those skilled in the art. The disclosures of the cited references throughout the application are incorporated by reference herein.

What is claimed is:

1. A method for manufacturing a carrier for a large object, the method comprising:

forming a bag from a sheet of plastic film material, wherein the bag is sized to receive a large object and has an opening at a first end for placing the object into the bag;

forming an extension on at least one side or on a second end of the bag, wherein the extension comprises a gusset including a plurality of layers of the plastic film material; and forming at least one handle including an opening in the extension on the side or the second end of the bag.

2. The method of claim 1 wherein the carrier is formed by an in-line process including an extrusion process.

3. The method of claim 1 wherein the carrier is formed not in-line by a conversion process.

4. The method of claim 1 wherein the handle opening is die cut through a heat sealed patch reinforcement.

5. The method of claim 1 wherein the handle opening is die cut through an applied pressure sensitive patch reinforcement.

6. The method of claim 1 wherein the handle opening is burned through the extension.

7. The method of claim 1 wherein the handle includes a cardboard reinforcement.

8. A method for manufacturing a carrier for a large object, the method comprising:

forming a bag from a sheet of plastic film material, wherein the bag is sized to receive a large object and has an opening at a first end for placing the object into the bag;

forming an extension on a side or on a second end of the bag, wherein the extension comprises a gusset having a first side and a second side, and wherein each of the gusset first side and second side comprises at least two layers of the plastic film material; and forming a handle in the extension on the side or second end of the bag, wherein the handle includes a hole formed through the first and second gusset sides.

9. The method of claim 8 wherein the carrier is formed by an in-line process including an extrusion process.

10. The method of claim 8 wherein the carrier is formed not inline by a conversion process.

11. The method of claim 8 further comprising:

forming a second extension in a second side or the second end of the bag and forming a second handle in the second extension.

12. The method of claim 11 wherein the second extension comprises a second gusset having a first side and a second side, and wherein each of the second gusset first side and second side comprises at least two layers of the plastic film material.

13. A method for manufacturing a carrier for a large object, the method comprising:

forming a bag, wherein the bag has an opening for placing an object into the bag;

forming a first extension on a first side or end of the bag, wherein the first extension comprises a gusset including multiple layers of film on the first side or end of the bag and the gusset has a first gusset side and an opposing second gusset side;

forming a first handle in the first extension, wherein the first handle is formed through the first and second gusset sides of the first extension; and forming a second extension on another side or end of the bag, wherein the second extension comprises a gusset including multiple layers of film on the second side or end of the bag and the gusset has a first gusset side and an opposing second gusset side; and forming a second handle in the second extension, wherein the second handle is formed through the first and second gusset sides of the second extension.

14. The method of claim 13 wherein the carrier is formed by an in-line process including an extrusion process.

15. The method of claim 13 wherein the carrier is formed not inline by a conversion process.

16. The method of claim 13 wherein at least one of the handles is die cut through a heat sealed patch reinforcement.

17. The method of claim 13 wherein at least one of the handles is die cut through an applied pressure sensitive patch reinforcement.

18. The method of claim 13 wherein at least one of the handles is burned through.

19. The method of claim 13 wherein at least one of the handles is applied as a rigid or flexible handle.

20. The method of claim 13 wherein at least one of the handles includes a cardboard reinforcement.

* * * * *